US008246814B2

(12) United States Patent
Koseoglu

(10) Patent No.: US 8,246,814 B2
(45) Date of Patent: Aug. 21, 2012

(54) PROCESS FOR UPGRADING HYDROCARBON FEEDSTOCKS USING SOLID ADSORBENT AND MEMBRANE SEPARATION OF TREATED PRODUCT STREAM

(75) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 407 days.

(21) Appl. No.: 12/454,298

(22) Filed: May 15, 2009

(65) Prior Publication Data

US 2009/0321309 A1 Dec. 31, 2009

Related U.S. Application Data

(63) Continuation-in-part of application No. 11/985,533, filed on Nov. 14, 2007, now Pat. No. 7,799,211, and a continuation-in-part of application No. 11/593,968, filed on Nov. 6, 2006, now Pat. No. 7,763,163, and a continuation-in-part of application No. 11/584,771, filed on Oct. 20, 2006, now Pat. No. 7,566,394.

(51) Int. Cl.
*C10C 3/08* (2006.01)

(52) U.S. Cl. ..... 208/250; 208/39; 208/298; 208/299; 208/305; 208/307; 502/400; 502/402; 502/407

(58) Field of Classification Search ..... 208/39, 208/250, 298–299, 305, 307; 502/400, 402, 502/407

See application file for complete search history.

(56) References Cited

U.S. PATENT DOCUMENTS 2,522,065 A 9/1950 Short (Continued)

FOREIGN PATENT DOCUMENTS

DE 102006024397 10/2007

(Continued)

OTHER PUBLICATIONS

Ohya, H. et al. (1997) Journal of Membrane Science, 123, 143-147.*

(Continued)

*Primary Examiner* — Walter D Griffin
*Assistant Examiner* — Brian McCaig
(74) *Attorney, Agent, or Firm* — Abelman, Frayne & Schwab

(57) ABSTRACT

A process for upgrading crude oil fractions or other hydrocarbon oil feedstreams boiling in the range of 36° to 520° C., and preferably naphtha and gas oil fractions boiling in the range of 36° to 400° C., employs a solid adsorption material to lower sulfur and nitrogen content by contacting the hydrocarbon oil, and optionally a viscosity-reducing solvent, with one or more solid adsorbents such as silica gel or silica, silica alumina, alumina, attapulgus clay and activated carbon in a mixing vessel for a predetermined period of time; passing the resulting slurry to a membrane separation zone, optionally preceded by a primary filtration step (i.e., single stage or multiple stages), to separate the solid adsorption material with the adsorbed sulfur and nitrogen compounds from the treated oil; recovering the upgraded hydrocarbon product having a significantly reduced nitrogen and sulfur content as the membrane permeate; mixing the solid adsorbent material with one or a combination of aromatic solvents such as toluene, benzene, the xylenes and tetrahydrofuran to remove and stabilize the sulfur and nitrogen compounds; transferring the solvent to a fractionation tower to recover the solvent, which can be recycled for use in the process; and recovering the hydrocarbons that are rich in sulfur and nitrogen for processing in a relatively small high-pressure hydrotreating unit or transferring them to a fuel oil pool for blending.

27 Claims, 1 Drawing Sheet

U.S. PATENT DOCUMENTS 3,227,645 A 1/1966 Frumkin et al.
3,252,894 A 5/1966 Gatsis et al.
3,315,003 A 4/1967 Khelghatian
3,410,794 A 11/1968 Li
3,719,590 A 3/1973 Li et al.
3,767,563 A 10/1973 Woodle
3,996,130 A 12/1976 Nametkin et al.
4,045,330 A 8/1977 Avrillon et al.
4,119,530 A 10/1978 Czajkowski et al.
4,172,842 A 10/1979 Schlinger et al.
4,239,616 A 12/1980 Gearhart
4,290,880 A 9/1981 Leonard
4,305,814 A 12/1981 Leonard
4,359,596 A 11/1982 Howard et al.
4,391,677 A 7/1983 Harris et al.
4,411,790 A 10/1983 Arod et al.
4,427,539 A 1/1984 Busch et al.
4,447,315 A 5/1984 Lamb et al.
4,468,316 A 8/1984 Swanson
4,502,944 A 3/1985 Nelson
4,572,781 A 2/1986 Krasuk et al.
4,618,412 A 10/1986 Hudson et al.
4,624,776 A 11/1986 Long et al.
4,634,516 A 1/1987 Haskell et al.
4,663,028 A 5/1987 Ditman
4,747,936 A 5/1988 Penning
4,770,764 A 9/1988 Ohtake et al.
4,775,460 A 10/1988 Reno
4,804,457 A 2/1989 Ngan
4,810,367 A 3/1989 Chombart et al.
4,816,140 A 3/1989 Trambouze et al.
4,831,207 A 5/1989 O'Keefe et al.
4,831,208 A 5/1989 Zarchy
4,835,338 A 5/1989 Liu
4,836,993 A 6/1989 Bertolacini et al.
4,846,962 A 7/1989 Yao
4,885,080 A 12/1989 Brown et al.
4,894,141 A 1/1990 Busch et al.
4,904,347 A 2/1990 Cros et al.
4,929,358 A 5/1990 Koenitzer
4,944,862 A 7/1990 Chen et al.
4,954,242 A 9/1990 Gruia
4,997,544 A 3/1991 Chou et al.
5,039,418 A 8/1991 Schucker
5,063,186 A 11/1991 Schucker
5,075,006 A 12/1991 Schucker
5,082,987 A 1/1992 Olbrich et al.
5,107,059 A 4/1992 Chen et al.
5,114,689 A 5/1992 Nagji et al.
5,124,023 A 6/1992 Bosserman et al.
5,173,172 A * 12/1992 Adams et al. ..... 208/39
5,190,633 A 3/1993 Fetzer et al.
5,209,838 A 5/1993 Sleppy et al.
5,220,106 A 6/1993 Boate et al.
5,221,481 A 6/1993 Schucker
5,241,039 A 8/1993 Ho et al.
5,308,586 A 5/1994 Fritsche et al.
5,320,816 A 6/1994 Tsai et al.
5,366,634 A 11/1994 Vijayan et al.
5,374,350 A 12/1994 Heck et al.
5,505,841 A 4/1996 Pirbazari et al.
5,512,179 A 4/1996 Bruschke et al.
5,624,547 A 4/1997 Sudhakar et al.
5,643,442 A 7/1997 Sweet et al.
5,843,300 A 12/1998 Zinnen et al.
5,905,182 A 5/1999 Streicher et al.
5,914,435 A 6/1999 Streicher et al.
5,928,518 A 7/1999 Schafer-Treffenfeldt et al.
6,024,880 A 2/2000 Ciora, Jr. et al.
6,180,008 B1 1/2001 White
6,187,987 B1 2/2001 Chin et al.
6,217,746 B1 4/2001 Thakkar et al.
6,248,230 B1 6/2001 Min et al.
6,273,937 B1 8/2001 Schucker
6,352,638 B2 3/2002 Jacobson et al.
6,406,616 B1 6/2002 Rappas et al.
6,524,469 B1 2/2003 Schucker
6,551,501 B1 4/2003 Whitehurst et al.
6,558,531 B2 5/2003 Steffens et al.
6,579,343 B2 6/2003 Brennecke et al.
6,649,061 B2 11/2003 Minhas et al.
6,702,945 B2 3/2004 Saxton et al.
6,736,961 B2 5/2004 Plummer et al.
6,783,662 B2 8/2004 Draemel et al.
6,805,790 B2 10/2004 Gupta et al.
6,896,796 B2 5/2005 White et al.
7,001,504 B2 2/2006 Schoonover
7,018,527 B2 3/2006 White et al.
7,041,212 B2 5/2006 White et al.
7,048,846 B2 5/2006 White et al.
7,114,566 B2 10/2006 Vinegar et al.
7,144,498 B2 12/2006 McCall et al.
7,267,761 B2 9/2007 Balko
7,314,565 B2 1/2008 Sabottke et al.
7,318,898 B2 1/2008 Sabottke
7,341,663 B2 3/2008 Offeman et al.
7,452,405 B2 11/2008 Duraiswamy et al.
7,459,072 B2 12/2008 Bitterlich et al.
7,619,129 B2 11/2009 DeJong et al.
2001/0045377 A1 11/2001 Morishima et al.
2002/0111524 A1 8/2002 Minhas et al.
2002/0139719 A1 10/2002 Minhas et al.
2003/0089638 A1 5/2003 Gueret et al.
2005/0067323 A1 3/2005 Balko
2005/0143612 A1 6/2005 Hwang et al.
2006/0159603 A1 7/2006 Vanheusden et al.
2006/0175229 A1 8/2006 Montanari et al.
2006/0211906 A1 9/2006 Berezutskiy
2006/0226083 A1 * 10/2006 Suzuki et al. ..... 210/665
2007/0062870 A1 3/2007 Chen et al.
2007/0267327 A1 11/2007 Boakye
2008/0011680 A1 1/2008 Partridge et al.
2008/0035574 A1 2/2008 Sabottke et al.
2008/0093260 A1 4/2008 Koseoglu
2008/0105595 A1 5/2008 Koseoglu
2009/0107890 A1 4/2009 Hamad et al.
2009/0120842 A1 5/2009 Koseoglu et al.

FOREIGN PATENT DOCUMENTS

EP 0 366 844 5/1990
EP 1 466 894 10/2004
GB 1146105 3/1969
JP 2138136 5/1990
KR 2004 0031921 4/2004

OTHER PUBLICATIONS

Sinnott, R.K. (2005). Chemical Engineering Design, 4th ed. Elsevier, 1038 pgs.*
International Search Report mailed on Feb. 13, 2009 by the ISA/US in application No. PCT/US2008/014075, p. 20.
Written Opinion mailed on Feb. 13, 2009 by the ISA/US in application No. PCT/US2008/014075, pp. 1-4.
International Preliminary Report on Patentability completed Jun. 19, 2010 by the ISA/US in application No. PCT/US2008/014075, pp. 1-23.
International Search Report mailed on Aug. 30, 2010 by the ISA/US in application No. PCT/US2010/040335; pp. 1-3.
Written Opinion mailed on Aug. 30, 2010 by the ISA/US in application No. PCT/US2010/040335, pp. 1-5.
International Search Report and Written Opinion of the ISA, PCT/US07/22381, Apr. 23, 2008, pp. 1-7.
Written Opinion of the IPEA, PCT/US07/22381, Apr. 23, 2008, pp. 1-8.
International Search Report and Written Opinion of the ISA, PCT/US07/23562, Mar. 17, 2008, pp. 1-7.
International Search Report and Written Opinion of the ISA, PCT/US08/012629, Jan. 5, 2009, pp. 1-7.
International Search Report and Written Opinion of the ISA, PCT/US10/034167, Nov. 5, 2010, pp. 1-13.

* cited by examiner

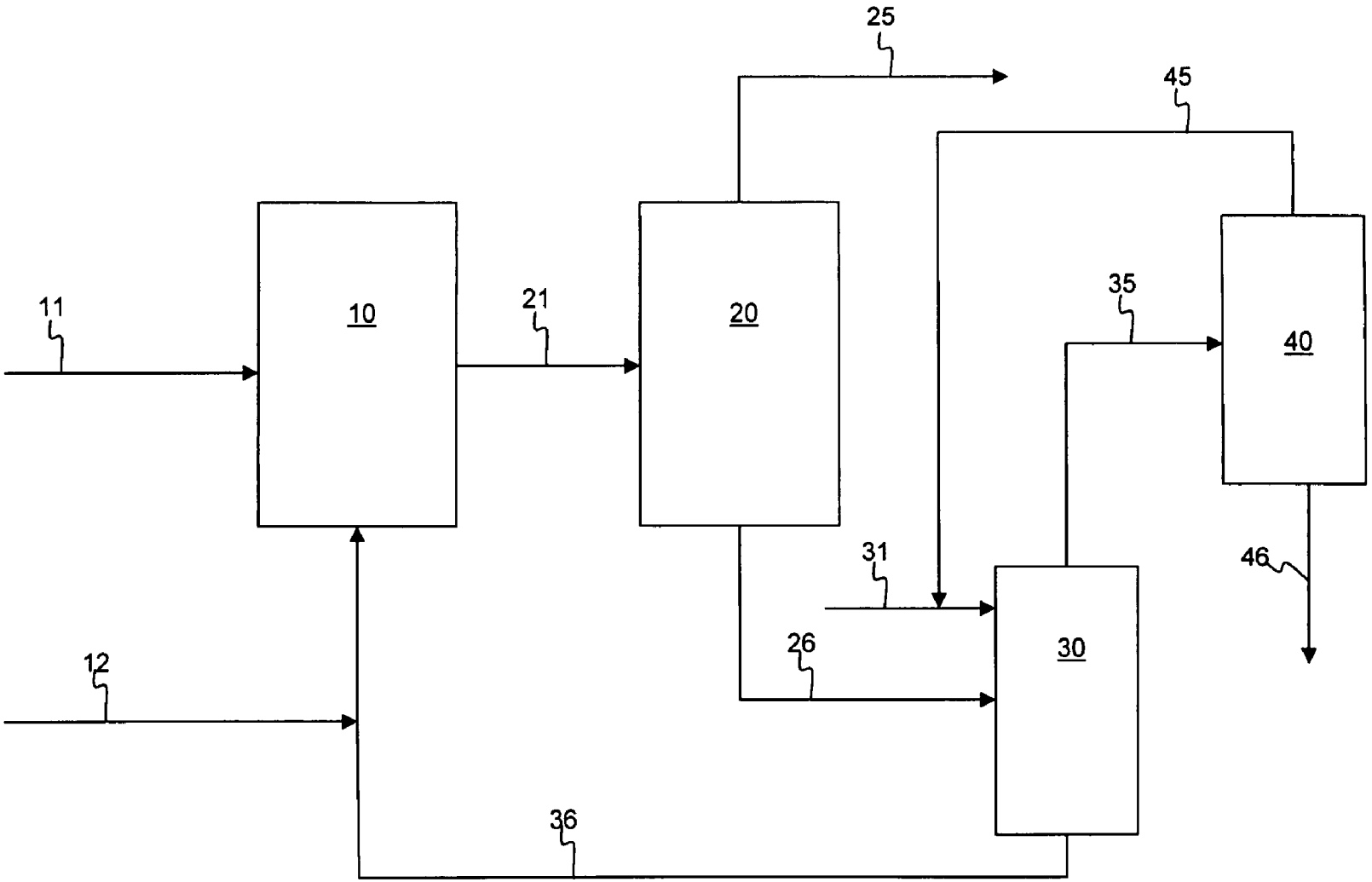
40
46
45
35
30
25
31
26
20
21
36
10
11
12

PROCESS FOR UPGRADING HYDROCARBON FEEDSTOCKS USING SOLID ADSORBENT AND MEMBRANE SEPARATION OF TREATED PRODUCT STREAM

RELATED APPLICATIONS

This application is a continuation-in-part of U.S. Ser. No. 11/985,533, now U.S. Pat. No. 7,799,211, filed Nov. 14, 2007, U.S. Ser. No. 11/593,968, now U.S. Pat. No. 7,763,163, filed Nov. 6, 2006, and U.S. Ser. No. 11/584,771, now U.S. Pat. No. 7,566,394, filed Oct. 20, 2006, the disclosures of which applications are incorporated herein by reference.

BACKGROUND OF THE INVENTION

1. Field of the Invention

This invention relates to the upgrading of hydrocarbon oil feedstock to remove undesirable sulfur- and nitrogen-containing compounds using solid adsorbents.

2. Description of Related Art

Various references disclose processes for the direct separation of sulfur compounds from naphtha and diesel feedstreams using membrane separation technology or solid adsorption methods. The following are representative of certain process treatment steps.

In U.S. Pat. No. 6,524,469, a heavy oil conversion process is disclosed in which the heavy oil feed is first thermally cracked using visbreaking or hydrovisbreaking technology to produce a product that is lower in molecular weight and boiling point than the feed. The product is then deasphalted using an alkane solvent at a solvent to feed ratio of less than 2. The solvent and the deasphalted oil are separated from the asphaltenes through the use of a two-stage membrane separation system.

U.S. Pat. No. 6,736,961 describes a process for removing sulfur from a hydrocarbon employing with the use of a solid membrane. A relatively large quantity of feed stream containing liquid hydrocarbons and sulfur species is conveyed past one side of the solid membrane, while a relatively small quantity of a sweep stream is conveyed past the opposite side of the solid membrane. The feed sulfur species is transported in a permeate from the feed-stream through the solid membrane to the sweep stream. The feed stream is converted to a relatively large quantity of a substantially sulfur-free retentate stream containing a primary hydrocarbon product, while the sweep stream combines with the permeate to produce a relatively small quantity of a sulfur-enriched stream, which is amenable to further processing such as hydrotreating.

U.S. Pat. No. 6,896,796 describes a membrane process for the removal of sulfur species from a naphtha feed, in particular, FCC light cat naphtha. The process involves contacting a naphtha feed stream with a membrane having sufficient flux and selectivity to separate a sulfur deficient retentate fraction from a sulfur enriched permeate fraction, preferably, under pervaporation conditions. Sulfur deficient retentate fractions are useful directly into the gasoline pool. Sulfur-enriched permeate fractions are rich in sulfur containing aromatic and nonaromatic hydrocarbons and are further treated with conventional sulfur removal technologies, e.g. hydrotreating, to reduce sulfur content. The process of the invention provides high quality naphtha products having reduced sulfur content and a high content of olefin compounds.

In published patent application US2002/0111524, a process is disclosed for the separation of sulfur compounds from a hydrocarbon mixture using a membrane. Preferred hydrocarbon mixtures are oil refining fractions such as light cracked naphtha. Membranes are composed of either ionic or non-ionic materials and preferentially permeate sulfur compounds over other hydrocarbons. A single or multi-stage membrane system separates the hydrocarbon mixture into a sulfur-rich fraction and a sulfur-lean fraction. The sulfur-lean fraction may be used in fuel mixtures and the sulfur-rich fraction may be further treated for sulfur reduction.

U.S. Pat. No. 5,643,442 describes a process for distillate or hydrotreated distillate effluents, where an aromatics-rich permeate and an aromatics lean retentate are separated by use of a permselective membrane. The aromatic rich permeate is sent to a hydrotreater for further processing, thereby increasing the quantity of reduced aromatics in the product.

U.S. Pat. No. 5,114,689 describes a process utilizing a primary adsorption bed containing a regenerable, physical adsorbent and an auxiliary sorption bed containing a chemisorbent for the removal of sulfur compounds from a fluid stream, which process purports to provide higher yields, higher purity and lower operating costs.

In published patent application US2002/0139719, methods for the separation of sulfur compounds from a liquid hydrocarbon mixture using a hydrophilic, non-ionic membrane are disclosed. The membrane can also be composed of water-soluble material. Preferred membranes include polyvinylpyrrolidone and cellulose triacetate membranes. The liquid hydrocarbon mixture can include a light cracked naphtha.

In U.S. Pat. No. 6,187,987, perm selective separation of aromatic hydrocarbons from non-aromatic hydrocarbons in a feed stream is accomplished using improved asymmetric membranes. The preferred membranes are fashioned from a polyimide and conditioned with lubricating oil. Feed streams containing a mixture of aromatic and non-aromatic hydrocarbons are contacted with the dense active layer side of the polyimide membrane under a pressure and temperature sufficient to selectively permeate the desired aromatic hydrocarbon.

U.S. Pat. No. 6,024,880 discloses a method suitable for treating used oil to remove contaminants including ash and color contaminants in order to provide a purified oil product. The method utilizes a porous inorganic membrane module having a high pressure side and a low pressure side. The oil to be treated is introduced to the high pressure side of the membrane module to provide an oil permeate on the low pressure side and an ash rich concentrate on the high pressure side thereby separating ash in the oil from the oil permeate. Thereafter, the oil permeate is contacted with an adsorbent to remove color and odor to provide a purified oil product. The spent adsorbent can be regenerated and reused.

In U.S. Pat. No. 5,082,987, a method and apparatus are described whereby a caustic-treated hydrocarbon feed mixture having a contaminating concentration of water and sulfur compounds is treated by separating the hydrocarbon feed into a first stream and a second stream. The first stream is contacted with an adsorbent material to produce a reactor feed stream having a significant reduction in the concentration of the contaminating water and sulfur compounds. The reactor feed stream is thereafter contacted in the presence of hydrogen under suitable isomerization conditions with an isomerization catalyst to produce an isomerate product.

Thus, while membrane technology and adsorbent technology have been separately applied to provide cleaner fuels, no disclosure has been found suggesting that both technologies be combined to separate the impurities from a hydrocarbon oil.

It is therefore an object of the present invention to provide an improved process for upgrading a hydrocarbon oil feedstream by removing and reducing the amounts of undesired sulfur- and nitrogen-containing compounds.

Another object of the invention is to provide such a process that is carried out under mild reaction conditions and utilizing conventional apparatus.

SUMMARY OF THE INVENTION

The above objects and other advantages are achieved by a process to upgrade crude oil fractions or other hydrocarbon feed streams from refining processes boiling in the range of 36-520° C., preferably naphtha and gas oil fractions boiling in the range 36-400° C. that employs a solid adsorption step to lower sulfur and nitrogen content that is followed by membrane separation of the solid adsorption material. The gas oil is contacted with one or more solid adsorbents such as silica, silica alumina, alumina, attapulgus clay, activated carbon and fresh or spent zeolite catalyst materials in a mixing vessel for a predetermined period of time. The resulting slurry is passed to a membrane separation zone, optionally preceded by a primary filtration step, i.e., a single stage or multiple stages, to remove the solid adsorption material with the adsorbed sulfur and nitrogen compounds. Following separation from the upgraded hydrocarbon product, the solid material is washed with one or a combination of aromatic solvents such as toluene, benzene, the xylenes and tetrahydrofuran to strip the sulfur and nitrogen compounds. The solvent with the undesired compounds is transferred to a fractionation tower to recover the solvent, which can then be recycled for use in the process. The recovered hydrocarbons that are rich in sulfur and nitrogen can either be efficiently processed in a relatively small high-pressure hydrotreating unit or be sent to a fuel oil pool for blending.

As used herein "membrane filtration" includes both ultrafiltration, e.g., particles in the range of 10 to 1000 Angstroms (Å), and microfiltration, e.g., particles in the range of 500 to 100,000 Å. As a preferred embodiment, the process and apparatus is configured to capture the particles in the microfiltration range.

The term ultrafiltration refers to the process of separating a liquid into fractions by pressure-driven flow through semi-permeable membranes having molecular weight cutoffs in the range of from 200 to 350,000 and pore diameters from about 10 to 1000 Angstroms. The semi-permeable membranes useful for ultrafiltration are referred to herein as "ultrafiltration membranes". The fraction which passes through the membranes is the "permeate" and the other fraction which is retained in the base liquid stream is the "retentate". The retentate does not pass through the membrane(s), but rather moves along the membrane surface and is recovered for further processing as described herein.

This invention combines the separate capabilities and advantages of solid adsorbents and membrane separation systems to desulfurize and upgrade hydrocarbon streams. It has been shown that solid adsorbents adsorb some of the poisonous heteroatom (sulfur and nitrogen) containing polynuclear aromatic molecules which lower fuel oil quality and have detrimental effects on the downstream refining processes. The present invention enables refiners to remove sulfur- and nitrogen-containing compounds from hydrocarbon streams boiling in the range 36°-520° C. at lower operating severities, i.e., conditions of temperature and/or pressure, than those used in conventional refining processes. By reducing the volume of the hydrocarbon stream and concentrating the nitrogen and sulfur compounds, a smaller treatment vessel that must be operated under more severe conditions can be used, thereby providing further economies to the overall process.

The process is applicable to naturally occurring hydrocarbons derived from crude oils, bitumens, heavy oils, shale oils and to hydrocarbon streams from refinery process units including hydrotreating, hydroprocessing, fluid catalytic cracking, coking, and visbreaking or coal liquefaction.

In a further preferred embodiment, a solvent can be added to the hydrocarbon oil when necessary to reduce its viscosity and achieve appropriate flow properties at atmospheric pressure and ambient temperatures. A suitable solvent is selected from paraffinic compounds having a carbon number of 3 to 7.

The adsorbents have an affinity for polar sulfur and nitrogen compounds, which are refractory in refining processes. Once they are removed from the hydrocarbon stream, they are separated from the upgraded hydrocarbon oil by membrane filtration systems.

The process of the present invention can be further described as comprising the steps of:

a. providing a hydrocarbon feedstock boiling in the range 36°-520° C. that contains undesired sulfur and nitrogen compounds;
b. mixing the hydrocarbon feedstock with a solid adsorbent in a mixing vessel and, optionally, with a paraffinic solvent (carbon number of 3-7) and at a temperature 20°-200° C. and pressure 1-100 $Kg/cm^2$;
c. continuing the mixing for a time that is sufficient to adsorb sulfur and/or nitrogen impurities on the adsorbent;
d. separating the solid adsorbent containing the impurities from the liquid phase in a membrane separation zone and collecting as the permeate a hydrocarbon oil of reduced sulfur and nitrogen compound content and a retentate mixture of adsorbent and hydrocarbons rich in sulfur and nitrogen impurities;
e. regenerating the solid adsorbent with a solvent and recycling the adsorbent for use in the process; and
f. recovering the sulfur- and nitrogen-containing hydrocarbon stream for further processing or use, e.g., in a fuel oil pool.

Solvents used in stripping and regenerating the adsorbent are selected based on their Hildebrand solubility factors or two-dimensional solubility factors. Examples of suitable polar solvents include toluene, benzene, xylenes and tetrahydrofuran.

BRIEF DESCRIPTION OF THE DRAWINGS

The foregoing summary, as well as the following detailed description of preferred embodiments of the invention will be best understood when read in conjunction with the attached drawing. For the purpose of illustrating the invention, there are shown in the drawings embodiments which are presently preferred. It should be understood, however, that the invention is not limited to the precise arrangements and instrumentalities shown. In the drawings the same numeral is used to refer to the same or similar elements, in which:

FIG. 1 is a schematic illustration of a preferred embodiment of the process for upgrading crude oil fractions or other hydrocarbon feed streams from refining processes that employs a solid adsorption step to lower sulfur and nitrogen content that is followed by membrane separation of the solid adsorption material.

DETAILED DESCRIPTION OF THE INVENTION

Referring now to FIG. 1, a hydrocarbon feedstream 11 and solid adsorbent material 12 are introduced into a mixing vessel 10 to form a slurry. The mixing is continued for a period of about 10 to 60 minutes at a temperature ranging from 20-150° C. and at a pressure of from 1-10 kg/cm$^2$. The mixing time can be predetermined empirically based upon the composition of the feedstream in order to optimize the adsorption of sulfur- and nitrogen-containing compounds by the adsorbent material.

A slurry stream 21 is then transferred to a membrane-filtration separation unit 20. A product permeate stream 25 passing through the membrane is completely or partially free of sulfur- and nitrogen-containing compounds. The upgraded product stream can be transferred as refinery naphtha for further processing or sent to the gas oil pool to be blended in the fuel pool.

A membrane retentate stream 26, which includes solid adsorbent with the sulfur- and nitrogen-containing hydrocarbons, is transferred to a separation unit 30 where it is mixed with a polar aromatic solvent stream 31 such as benzene, toluene, the xylenes, alkyl benzenes and/or tetrahydrofurans. The aromatic solve solubilizes or strips the nitrogen and sulfur compounds from the adsorbent. The solid phase is then separated from the liquid phase, e.g., by filtration. A stripped adsorbent stream 36 can be then recycled to the mixing vessel 10 for reuse.

A solvent and oil fraction stream 35 is transferred to a solvent fractionation unit 40. A solvent stream 45 is separated and recycled to the separation vessel 30 for reuse. A rejected oil fraction stream 46, which is high in sulfur and nitrogen compounds, can be sent to the fuel oil pool or to a high severity refining operation for further processing. It will be understood that the volume of stream 46 containing the sulfur and nitrogen compounds is a small fraction of the volume of the original feedstream.

As will be understood from the above description, the process of the invention combines adsorption and membrane separation to desulfurize the hydrocarbon streams selectively. The desulfurization is achieved using solid particles having a surface area at least 100 m$^2$/g, a pore size of at least 10 Å and a pore volume of about 0.1 cc/g. In certain embodiments, the membrane is selected for microfiltration. In additional embodiments, the membrane is selected for ultrafiltration, for example, under conditions in which significant quantities of reduced-size particles, i.e., in the range of 10 to 1000 Å. The membrane material can be of polysulfone, polyacrylonitrile, cellulose, and the membrane can be in the form of hollow fibers, flat sheets, spiral wound and other known configurations. The principal advantage of the present invention derives from the use of membrane microfiltration or, if necessary, ultrafiltration, to separate and recover all of the particles rich with impurities. During microfiltration or ultrafiltration a high concentration of solids may congregate at the surface of the membrane thus reducing permeate flow, or, for a constant flow rate, requiring an increase in the pressure drop across the wall or the hollow fibers. In this event, the membrane can be back-flushed at predetermined intervals with a suitable hydrocarbon solvent to reduce the concentration of solids near the inside wall of the hollow fibers. Suitable solvents for this purpose include paraffinic solvents such as those having a carbon numbers of 3 to 8, aromatic solvents such as benzene or toluene, or refinery streams such as naphtha or diesel.

Several types of suitable apparatus are known for carrying out the ultrafiltration step of this invention. One type is the "plate and frame" apparatus in which a series of plates support semi-permeable membranes and the feed or base liquid stream is passed across those membranes. Another is the "spiral membrane" apparatus in which the membrane is wrapped in a perforated collection tube and the liquid feed stream is passed through the length of the tube. When a slurry is fed to this type of ultrafiltration module, its membrane will retain the solid adsorbent, but allow the hydrocarbon or solvent to pass through the membrane. Accordingly, the retentate, which will be solid adsorbent richer in impurities such as organosulfur and nitrogen compounds than the feed is separated, and the permeate will have a significantly lower level of impurities than the feed. Thus, in the practice of the process of the invention, the upgraded hydrocarbon oil resulting from the ultrafiltration step will have a substantially lower sulfur and nitrogen content than the original feedstream.

Membranes alone are not selective in removing the impurities from the hydrocarbon fractions; however, they are very selective in removing distinct species from the solutions when the permeate-retentate fractions differ from each other by size and/or phase. In the process of the present invention, the polar refractory molecules are separated from the rest of the hydrocarbons with a solid adsorbent material, which is, in turn, easily separated from the liquid hydrocarbons.

In certain embodiments of the invention, the adsorbed refractory polar species are separated from the adsorbent in the process using a solvent extraction step, and the adsorbent is regenerated and recycled for subsequent reuse in the process. Solvents used in stripping and regenerating the adsorbent are selected based on their Hildebrand solubility factors, or two-dimensional solubility factors. The overall Hildebrand solubility parameter is a well-known measure of polarity and has been tabulated for numerous compounds. See, for example, Journal of Paint Technology, Vol. 39, No. 505, February 1967. The optimum solvent can also be described by a two-dimensional solubility parameter. See, for example, I. A. Wiehe, Ind. & Eng. Res., Vol. 34 (1995), p. 661 (1995). These are the complexing solubility parameter and the field force solubility parameter. The complexing solubility parameter component, which describes the hydrogen bonding and electron donor-acceptor interactions, measures the interaction energy that requires a specific orientation between an atom of one molecule and a second atom of a different molecule. The field force solubility parameter, which describes van der Walls and dipole interactions, measures the interaction energy of the liquid that is not destroyed by changes in the orientation of the molecules. The polar solvent or solvents, if more than one is employed, preferably have an overall solubility parameter greater than about 8.5 or a complexing solubility parameter greater than 1 and field force parameter greater than 8. Examples of polar solvents meeting the minimum solubility parameter are toluene (8.91), benzene (9.15), the xylenes (8.85) and tetrahydrofuran (9.52). Preferred polar solvents for use in the practice of the invention are toluene and tetrahydrofuran.

In additional embodiments of the present invention, heat treatment can be employed to desorb the polar molecules from the surface of the solid porous adsorbent material. The adsorbent material is heated at high temperatures of about 300-500° C., preferably about 400-450° C., under conditions of nitrogen flow of about 15-100 liters per hour for about 10-60 minutes. In certain preferred embodiments, the temperature of the adsorbent material is raised gradually to above the end boiling point of the hydrocarbon oil, e.g., diesel. As will be understood by one of ordinary skill in the art from the present disclosure, the desorption temperature depends on the boiling point of the adsorbed molecules and their polarity. The temperature and pressure conditions employed in the heat treatment should be selected so as to avoid initiation of cracking reactions that can form a carbon layer on the surface of the adsorbent material.

The following examples further illustrate the practice of the process of the invention.

EXAMPLE 1

A slurry was formed with 50 g of silica and 200 g of light diesel oil, i.e., 1:4 adsorbent to oil ratio. The light diesel oil had an API gravity of 37.4 degrees, an ASTM D86 distillation curve of 201/229/235/258/275/295/328/348/354 at IBP/5 W %/10 W %/30 W %/50 W %/70 W %/90 W %/95 W %/FBP, respectively, and contained 1.0 W % sulfur, and 42 ppmw nitrogen. The silica gel adsorbent had a 100-200 mesh size. The slurry was mixed with a magnetic stirrer at a rate of 60 RPM at 20° C. and atmospheric pressure for 30 minutes. The sulfur components present before and after the process of adsorption followed by membrane filtration are set forth in Table 1 below.

The hydrocarbon-solid adsorbent was transferred to a membrane filtration device with vacuum pressure applied, using a membrane having pores of 4-5 microns, for separation. The total diesel recovered was 164 g, or about 80 W %, after two minutes, and the total sulfur content was reduced by 40 W %. The remaining adsorbent was washed further with an equivalent volume of pentane, and the total oil recovery was 99W % after pentane evaporation. The sulfur removal by component is shown in Table 1:

TABLE 1

| Sulfur Component | Initial Concentration (ppmw) | Concentration After Adsorption and Membrane Filtration (ppmw) | Percent Reduction (W %) |
|---|---|---|---|
| dibenzothiophene | 340 | 174 | 48 |
| 4-methyl dibenzothiophene | 549 | 247 | 55 |
| 4,6-dimethyl dibenzothiphene | 190 | 95 | 50 |

All concentrations in the above Table 1 were determined using sulfur speciation chromatography. Sulfur removal was also monitored as a function of the boiling point of the sulfur compounds. The removal of sulfur compounds with a boiling point of 280° C. and above was only 20 W %, while the removal was 40 W % for sulfur compounds boiling around 390° C. and above. The product was also substantially free of measurable nitrogen.

EXAMPLE 2

A hydrotreated diesel containing 1009 ppmw of sulfur was subjected to membrane-adsorption desulfurization in a two-stage process. A slurry was formed as in Example 1, with 51 g of silica gel having 100-200 mesh size and 205 g of light diesel oil. The slurry was mixed with a magnetic stirrer at a rate of 60 RPM at 20° C. and atmospheric pressure for 30 minutes. The hydrocarbon-solid adsorbent slurry was transferred and the components separated in a membrane filtration device with vacuum pressure applied, using a membrane having pores of 4-5 microns. The total diesel recovered after two minutes was 163 g, about 80W %. The remaining adsorbent was washed further with an equivalent volume of pentane, and the total oil recovery was 99.0 W % after pentane evaporation. This completed the first stage.

In the second stage of the two-stage process, 158 g of the recovered diesel from the first stage was used to form a second slurry with 40 g of fresh silica adsorbent. The slurry was again mixed at a rate of 60 RPM at 20° C. and atmospheric pressure for 30 minutes, and the second batch of slurry was separated in a membrane filtration unit under vacuum conditions. The total upgraded diesel recovered after two minutes was 73 W %. The remaining adsorbent was washed further with an equivalent volume of pentane, and the total oil recovery was 99.4 W % after pentane evaporation. This completed the second stage. Thus, the original sulfur-containing diesel feedstream was subjected to two sequential adsorption and membrane separation steps.

EXAMPLE 3

A hydrotreated diesel containing 1009 ppmw of sulfur was subjected to membrane-adsorption desulfurization in a three-stage process. A slurry was formed as in Example 1, with 51 g of silica gel having 100-200 mesh size and 205 g of light diesel oil. The slurry was mixed with a magnetic stirrer at a rate of 60 RPM at 20° C. and atmospheric pressure for 30 minutes. The hydrocarbon-solid adsorbent slurry was transferred and the components separated in a membrane filtration device with vacuum pressure applied, using a membrane having pores of 4-5 microns. The total upgraded diesel recovered after two minutes was about 80 W %. The remaining adsorbent was washed further with an equivalent volume of pentane, and the total oil recovery was 99.0 W % after pentane evaporation. This completed the first stage.

In the second stage of the three-stage process, 158 g of the recovered diesel from the first stage was used to form a second slurry with 40 g of fresh silica adsorbent. The slurry was again mixed at a rate of 60 RPM at 20° C. and atmospheric pressure for 30 minutes, and the second batch of slurry was separated in a membrane filtration unit under vacuum conditions. The total upgraded diesel recovered after two minutes was 73 W %. The remaining adsorbent was washed further with an equivalent volume of pentane, and the total oil recovery was 99.4 W % after pentane evaporation. This completed the second stage. Thus, the original sulfur-containing diesel feedstream was subjected to two sequential adsorption and membrane separation steps.

In the third and final stage of the three-stage process, 67 g of the recovered diesel from the first stage was used to form a second slurry with 17 g of fresh silica adsorbent. The slurry was again mixed at a rate of 60 RPM at 20° C. and atmospheric pressure for 30 minutes, and the second batch of slurry was separated in a membrane filtration unit under vacuum conditions. The total upgraded diesel recovered after two minutes was 73 W %. The remaining adsorbent was washed further with an equivalent volume of pentane, and the total oil recovery was 99.9 W % after pentane evaporation. This completed the third stage. Thus, the original sulfur-containing diesel feedstream was subjected to three sequential adsorption and membrane separation steps.

Although the process and materials of the invention have been described in detail and by means of several examples, additional variations and modifications will be apparent to those of ordinary skill in the art from this description and the scope of the invention is to be determined and limited only by the claims that follow.

The invention claimed is:

1. A process for improving the quality of a hydrocarbon oil feedstock by removing undesirable sulfur and nitrogen compounds present in the feedstock, the process comprising:

a. introducing the hydrocarbon oil feedstock containing undesirable sulfur- and nitrogen-containing compounds into a mixing vessel with a solid adsorbent material that includes finely divided particles, the adsorbent material being selected from the group consisting of attapulgus clay, silica alumina, alumina, silica, silica gel, activated carbon and zeolite catalyst materials;

b. mixing the hydrocarbon oil feedstock with the adsorbent material to form a slurry;

c. continuing to mix the slurry for a time sufficient to adsorb sulfur- and nitrogen- containing molecules on the adsorbent material;

d. passing the hydrocarbon oil and solid adsorbent mixture through at least one primary filter to form a filtered hydrocarbon oil and solid adsorbent mixture; and e. contacting the filtered hydrocarbon oil and solid adsorbent mixture with a filtration membrane in a separation zone to separate an upgraded hydrocarbon oil product from the solid adsorbent and recovering a hydrocarbon oil product having a reduced sulfur and nitrogen compound content as the membrane permeate.

2. The process of claim 1 which includes the steps of:

f. recovering the solid adsorbent material and mixing it with at least one polar solvent for the adsorbed sulfur and nitrogen-containing compounds to desorb the adsorbed compounds;

g. recovering the solid adsorbent material for use in step (b); and h. passing the solvent mixture to a fractionator to recover the solvent for use in step (f).

3. The process of claim 2 which includes washing the recovered solid adsorbent with a paraffinic solvent to remove retained hydrocarbon oil feedstock prior to addition of the polar solvent.

4. A process for improving the quality of a hydrocarbon oil feedstock by removing undesirable sulfur and nitrogen compounds present in the feedstock, the process comprising:

a. introducing the hydrocarbon oil feedstock containing undesirable sulfur- and nitrogen-containing compounds into a mixing vessel with a solid adsorbent material that includes finely divided particles, the adsorbent material being selected from the group consisting of attapulgus clay, silica alumina, alumina, silica, silica gel, activated carbon and zeolite catalyst materials;

b. mixing the hydrocarbon oil feedstock with the adsorbent material to form a slurry;

c. continuing to mix the slurry for a time sufficient to adsorb sulfur- and nitrogen-containing molecules on the adsorbent material;

d. contacting the hydrocarbon oil and solid adsorbent mixture with a filtration membrane in a separation zone to separate an upgraded hydrocarbon oil product from the solid adsorbent and recovering a hydrocarbon oil product having a reduced sulfur and nitrogen compound content as the membrane permeate;

e. recovering the solid adsorbent material;

f. washing the recovered solid adsorbent material with a paraffinic solvent to remove retained hydrocarbon oil feedstock;

g. mixing the washed and recovered solid adsorbent material with at least one polar solvent for the adsorbed sulfur and nitrogen-containing compounds to desorb the adsorbed compounds;

h. recovering the solid adsorbent material for use in step (b); and i. passing the solvent mixture to a fractionator to recover the solvent for use in step (g).

5. The process of claim 1 or 4 in which the solid adsorbent particles have a surface area of at least 100 $m^2/g$, a pore size of at least 10 angstroms and a pore volume of 0.1 cc/g.

6. The process of claim 4 in which the solid adsorbent and oil mixture in step (d) is passed through a least one primary filter upstream of the membrane.

7. The process of claim 1 or 6 wherein the primary filter serves to filter particles having a dimension greater than 200 mesh size (74 microns).

8. The process of claim 1 or 6 wherein the primary filter serves to filter particles having a dimension greater than 100 mesh size (149 microns).

9. The process of claim 1 or 4 in which the membrane is a microfiltration or an ultrafiltration membrane.

10. The process of claim 1 or 4, wherein the hydrocarbon oil feedstock is derived from a natural source selected from crude oil, tar sands, bitumen and shale oil.

11. The process of claim 1 or 4 , wherein the hydrocarbon feedstock is derived from refining processes and is selected from the group consisting of atmospheric and vacuum residue, fluid catalytic cracking products, slurry oil, coker bottom oils, visbreaker bottoms and coal liquefaction oils.

12. The process of claim 1 or 4 which includes adding a paraffinic solvent having a carbon number of 3 to 7 to the hydrocarbon oil in step (a).

13. The process of claim 12 in which the amount of paraffinic solvent employed is determined empirically to provide a feedstream having a viscosity within a predetermined range.

14. The process of claim 1 or 4 in which the polar solvent is an aromatic compound.

15. The process of claim 14 in which the polar aromatic solvent is selected from the group consisting of benzene, toluene, xylenes, alkyl benzenes, tetrahydrofuran, and mixtures thereof.

16. The process of claim 2 or 4, wherein the at least one solvent to despob the adsorbed compounds is selected based on the Hildebrand solubility factors or the two-dimensional solubility factors.

17. The process of claim 1 or 4 in which the filtration membrane comprising a composition selected from the group polysulfone, polyacrylonile and cellulose.

18. The process of claim 17 in which the filtration membrane is in the form of a hollow-wound spiral, a flat sheet or hollow fibers.

19. The process of claim 1 or 4 which includes the step of back-flushing the membrane with a hydrocarbon solvent at predetermined intervals.

20. The process of claim 3 or 4 which includes recovering the hydrocarbon oil from the paraffinic solvent.

21. The process of claim 1 or 4 wherein step (b) occurs at a temperature in the range of 20° C. to 200° C.

22. The process of claim 1 or 4 wherein step (b) occurs at a temperature in the range of 20° C. to 150° C.

23. The process of claim 1 or 4 wherein step (b) occurs at a pressure in the range of 1 $Kg/cm^2$ to 100 $Kg/cm^2$.

24. The process of claim 1 or 4 wherein step (b) occurs at a pressure in the range of 1 $Kg/cm^2$ to 10 $Kg/cm^2$.

25. The process of claim 1 or 4 wherein the time in step (c) is from 10 minutes to 60 minutes.

26. The process of claim 1 or 4 wherein the feedstock consists of hydrocarbon components boiling in the range of from 36° C. to 520° C.

27. The process of claim 1 or 4 wherein the feedstock consists of hydrocarbon components boiling in the range of from 36° C. to 400° C.

* * * * *